US008263883B2

(12) United States Patent
Heien

(10) Patent No.: US 8,263,883 B2
(45) Date of Patent: Sep. 11, 2012

(54) MECHANICAL DELAY TIMER

(76) Inventor: Troy A. Heien, Laramie, WY (US)

( * ) Notice: Subject to any disclaimer, the term of this patent is extended or adjusted under 35 U.S.C. 154(b) by 516 days.

(21) Appl. No.: 12/386,542

(22) Filed: Apr. 20, 2009

(65) Prior Publication Data

US 2010/0264003 A1 Oct. 21, 2010

(51) Int. Cl.
*H01H 7/08* (2006.01)

(52) U.S. Cl. ..... 200/38 R; 200/38 A

(58) Field of Classification Search ..... 200/38 R
See application file for complete search history.

(56) References Cited

U.S. PATENT DOCUMENTS

| | | | | | |
|---|---|---|---|---|---|
| 2,524,215 | A | | 10/1950 | Wegehoft | |
| 2,912,051 | A | * | 11/1959 | Albert | 318/466 |
| 3,582,580 | A | * | 6/1971 | Drachi | 200/38 R |
| 3,818,156 | A | | 6/1974 | Augustyniak | |
| 3,984,700 | A | * | 10/1976 | Sheridan | 307/139 |
| 4,021,626 | A | * | 5/1977 | Becker | 200/33 R |
| 4,164,635 | A | * | 8/1979 | Finch et al. | 200/33 R |
| 4,297,545 | A | * | 10/1981 | Darner | 200/38 R |
| 4,348,564 | A | * | 9/1982 | Ohtaki et al. | 200/404 |
| 4,381,431 | A | * | 4/1983 | Ritzenthaler et al. | 200/38 R |
| 4,912,376 | A | | 3/1990 | Strick | |
| 5,397,869 | A | | 3/1995 | Huen | |
| 5,719,362 | A | | 2/1998 | Gray | |
| 5,806,665 | A | * | 9/1998 | Houssian | 200/330 |
| 6,861,601 | B2 | | 3/2005 | Heien | |
| 7,525,058 | B1 | * | 4/2009 | Daffin, III | 200/331 |
| D603,346 | S | * | 11/2009 | Murray et al. | D13/162 |

* cited by examiner

*Primary Examiner* — Elvin G Enad
*Assistant Examiner* — Lisa Homza
(74) *Attorney, Agent, or Firm* — Roland H. Shubert

(57) ABSTRACT

A mechanical delay timer for operating either a toggle or a rocker-type wall switch to change the position of the switch after a preset interval includes a spring powered timer that drives a cam which, in turn, causes movement of an actuator that is arranged to engage either the toggle lever of a toggle wall switch or the rocker member of a rocker-type wall switch to move the switch from one position to another. The timer mechanism is contained within a housing that attaches to a timer base which, in turn, mounts over the existing cover plate of a conventional wall switch.

14 Claims, 6 Drawing Sheets

MECHANICAL DELAY TIMER

BACKGROUND OF THE INVENTION

1. Technical Field

This invention relates generally to a mechanical delay timer that is arranged to turn a light switch or other electric switch on or off after a pre-set interval.

More specifically, this invention relates to a mechanical delay timer that operates the existing switch mechanism of either a toggle or a rocker switch to allow the switch to be turned on and to then turn the switch off after a pre-set interval.

2. Description of Related Art

There are numerous devices for controlling individual lights and appliances to turn them on or off at pre-set times. Those devices typically are electromechanical in operation and may employ a small electric motor to change the position of a switch in series with the light or controlled appliance. That arrangement requires a power source which usually is a connection to the same source as supplies the light or appliance or both. A drawback to such devices is that they cannot be used for control of a prior installed conventional wall switch.

There are also devices that can operate the switch mechanism of a conventional toggle wall switch. See, for example, U.S. Pat. No. 4,912,376 which describes a timed actuator for a conventional toggle wall switch, U.S. Pat. No. 5,719,362 directed to a timer control device for a wall mounted toggle switch, and the inventor's prior U.S. Pat. No. 6,861,601 which describes a mechanical delay timer. All of those prior patents are directed to devices which control operation of a conventional toggle switch. None have the capability of controlling the operation of either a rocker switch or a toggle switch or both.

Hence, it is an object of this invention to provide a self-contained mechanical timer that can be secured to the cover plate of a conventional toggle or rocker type wall switch for timed actuation of the existing switch.

It is a further object of this invention to provide a spring driven, mechanical, timer control device which operates either a toggle or a rocker wall switch and mounts directly over the existing switch cover plate.

Other objects and features of the invention will become apparent from the following description of preferred embodiments considered in connection with the accompanying drawings.

SUMMARY OF THE INVENTION

The delay timer of this invention is arranged to be installed over an existing or prior installed switch to change the switch position of either a toggle or a rocker type wall switch after a preset interval or to allow normal operation of the switch. The delay timer includes a spring driven timer means that rotates a cam plate which, in turn, imparts movement to an actuator through a cam follower which is attached to or is part of the actuator. The timer means, cam plate, and actuator are mounted within a housing which attaches to a timer base plate that fits over an existing switch cover plate without modification or disassembly of the switch. Movement of the actuator causes the toggle lever of a toggle switch to change position and also imparts a sliding motion to a pair of rails formed as extensions to the actuator and positioned to interact with the rocker member of a conventional rocker-type wall switch to cause the switch position to change from its "on" position to its "off" position.

DESCRIPTION OF PREFERRED EMBODIMENTS OF THE INVENTION

Figure 1:
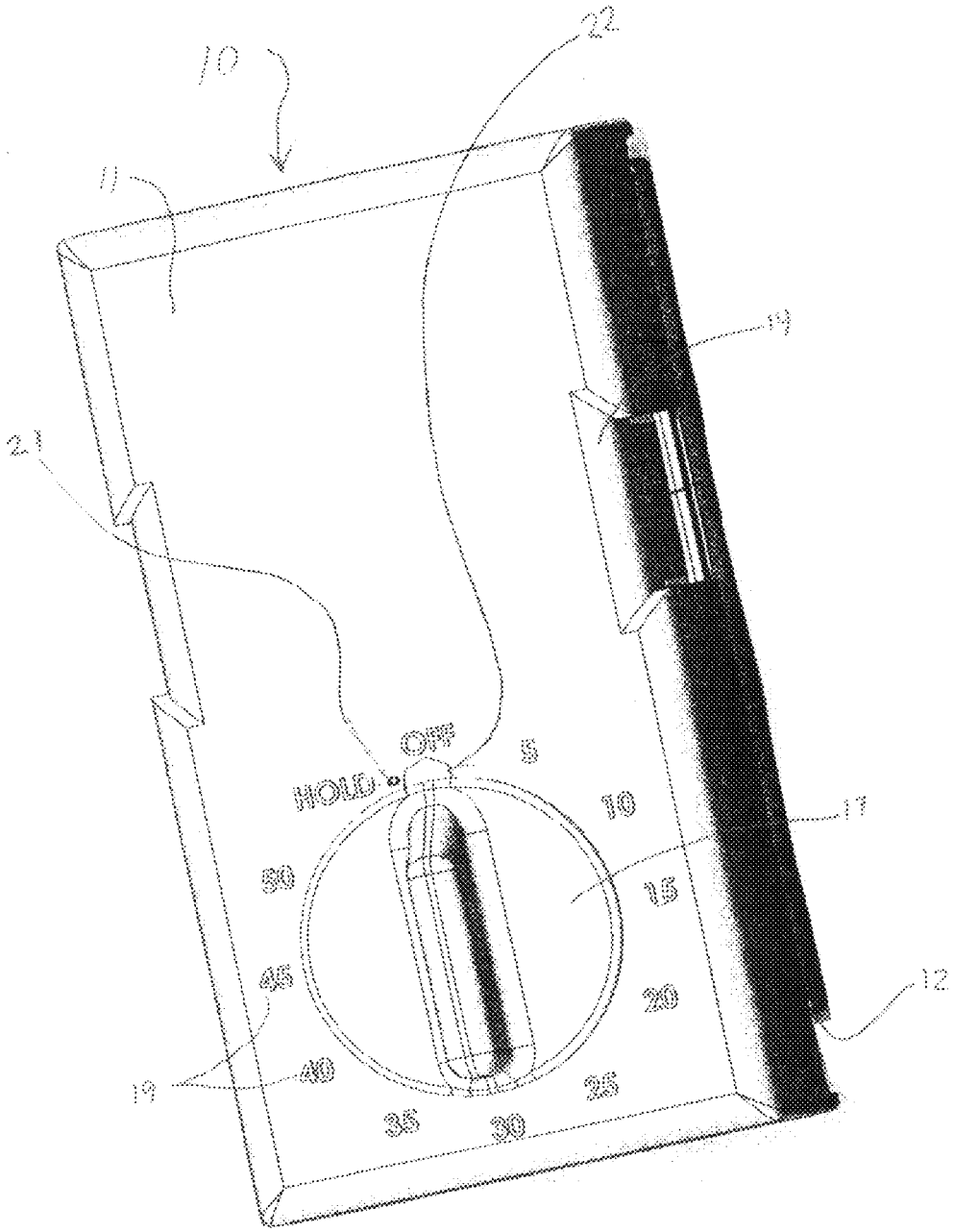
FIG. 1 is a front perspective view of a mechanical delay timer in accordance with this invention.

FIG. 1 shows the delay timer 10 as it would appear mounted over the cover plate of a conventional toggle or rocker wall switch. Timer 10 includes a timer housing 11 that fits over the cover plate 12 of a conventional toggle switch having a protruding lever or handle, or over the cover plate of a rocker switch in which one side of the switch is raised and the other side is depressed. The housing locks to a timer base (not shown in this view) by means of tab locks 14 and 15. A rotatable control knob 17 for setting the time delay for switch operation is located adjacent the bottom of the timer housing and is encircled by a time scale 19 that may be calibrated in minutes. The time delay for switch operation is set by clockwise rotation of the control knob to the chosen setting. A small counter-clockwise rotation, from the "off" position to the "hold" position, does not engage the timer, but turns the switch on until the control knob is again turned. A removable stop such as a threaded peg or screw 21 may be fitted into a receptacle placed so the stop interferes with the pointer end 22 of control knob 17 to prevent counter-clockwise rotation of the knob thus requiring the switch to be operated in a timed mode only.

Figure 2:
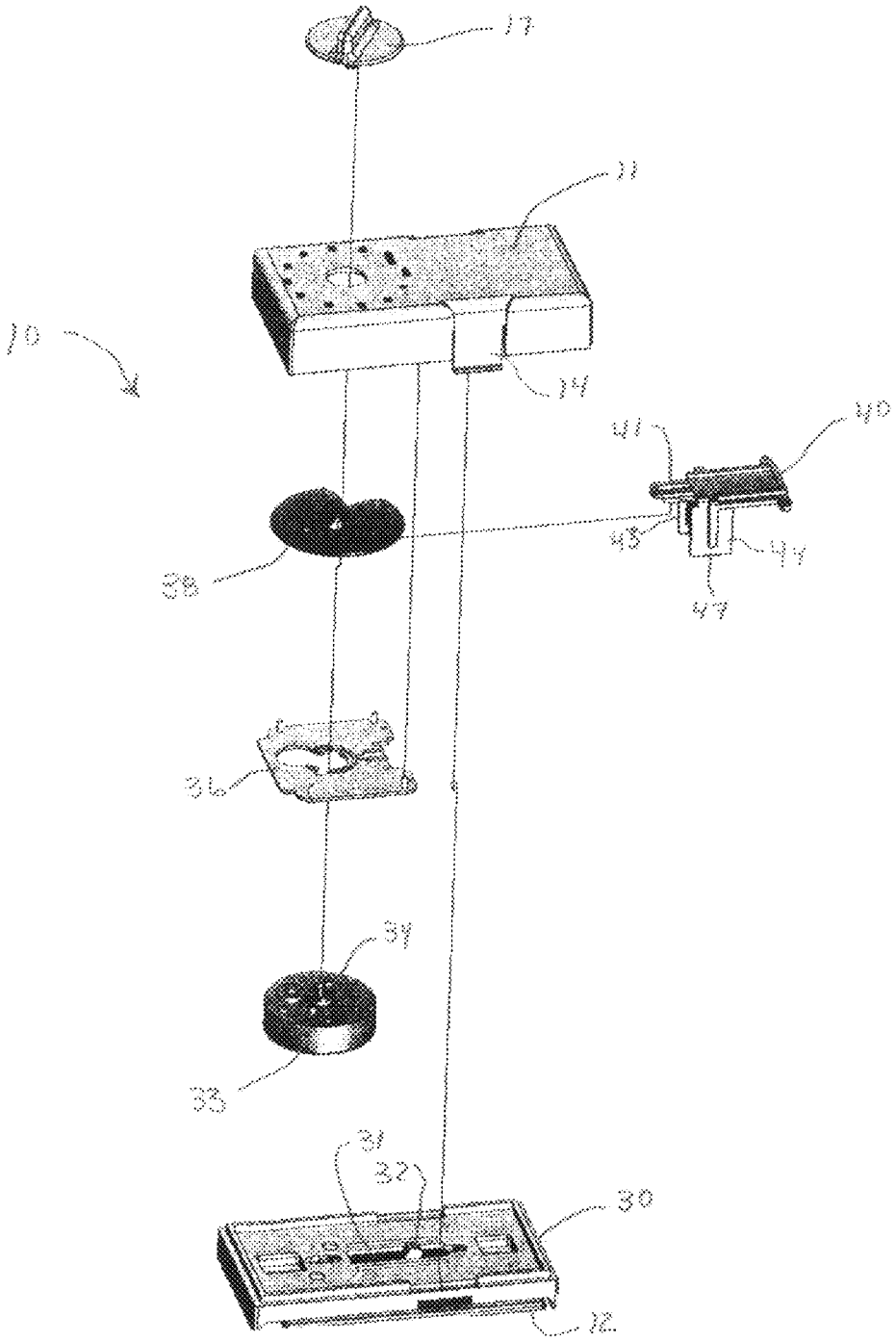
FIG. 2 is an exploded perspective view showing the major components of the timer and their relationship one to another.

Turning now to FIG. 2, the major structural components of the delay timer are shown in exploded view. The timer base plate 30 is sized to fit over the cover plate of a standard toggle or rocker wall switch and is fixed thereto using screws that extend through the timer base plate 30 and through the switch cover plate 12. Base plate 30 is provided with a centrally located, generally rectangular slot opening 31 that is sized to fit over the toggle lever 32 of a conventional wall switch and to allow its free movement between "off" and "on" positions.

A spring wound mechanical timer 33, such as those used as kitchen timers and the like, is mounted above the timer base plate. The winding stem 34 of timer 33 extends upwardly through an opening in locating plate 36 to rotationally drive cam 38 and connect to control knob 17. Locating plate 36 functions to hold the timer, cam, and control knob in positional alignment with the timer housing. Cam 38 may be a plate like, generally circular member having at least one change in radius or profile. An actuator member 40 having a cam follower 41 at one end thereof is positioned to interact with the cam to slide the actuator back and forth as the cam profile changes. Actuator 40 is better shown in FIGS. 3, 4, 5, and 6 and includes a pair of leg members 43 and 44 which extend perpendicularly to the plane of the actuator terminating in rails 46 and 47. An actuator back member 51 is positioned at the end of the actuator member opposite the cam follower and extends perpendicular to the plane of the actuator and perpendicular as well to the leg members. A similar front member 53 (FIG. 6), together with the back member 51 and legs 43 and 44, form a box-like containment for the toggle of a conventional toggle wall switch and cause the switch to move from an "on" to an "off" position as the actuator moves in response to the rotational position of the cam.

Figure 3:
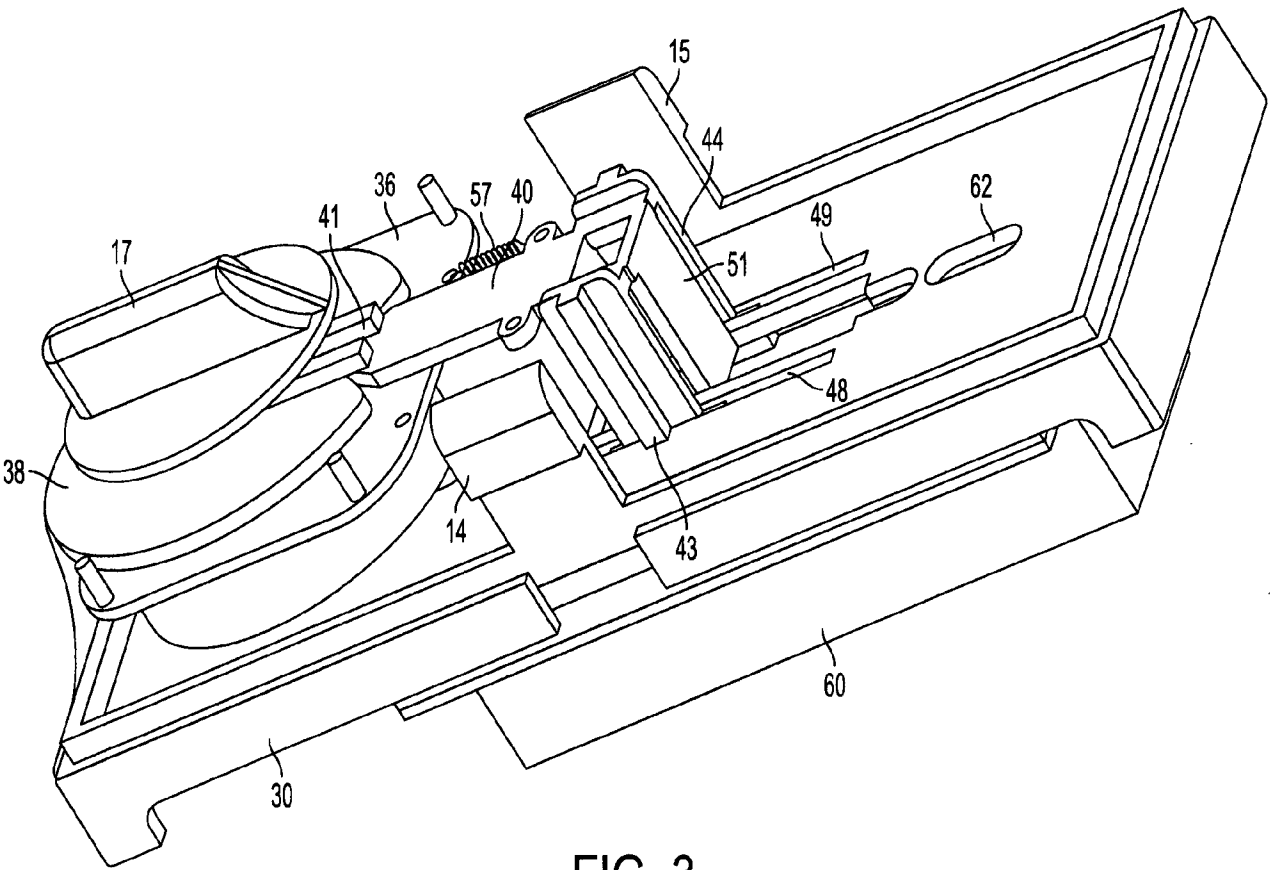
FIG. 3 is a partially cut away perspective view of the components shown in FIG. 2.
Figure 5:
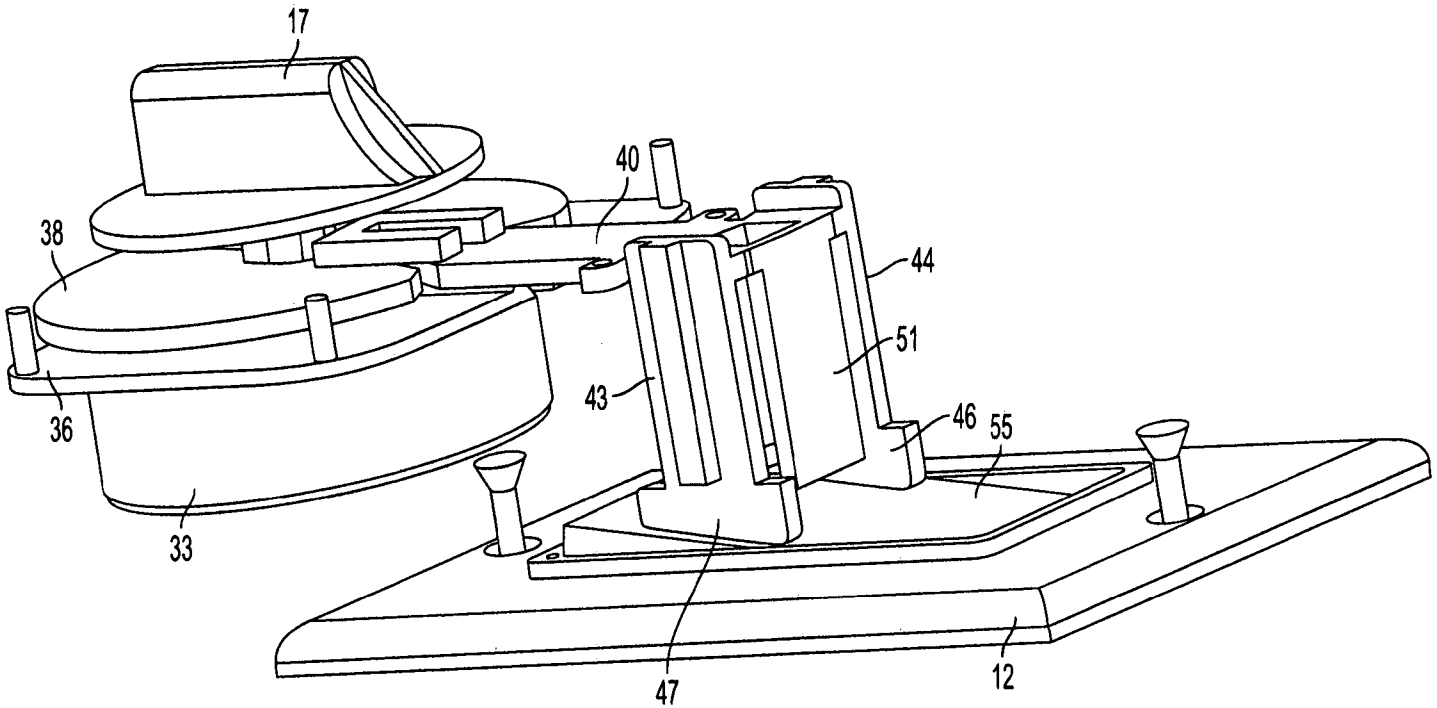
FIG. 5 is a perspective, partially disassembled view of the delay timer shown in association with a rocker switch.
Figure 6:
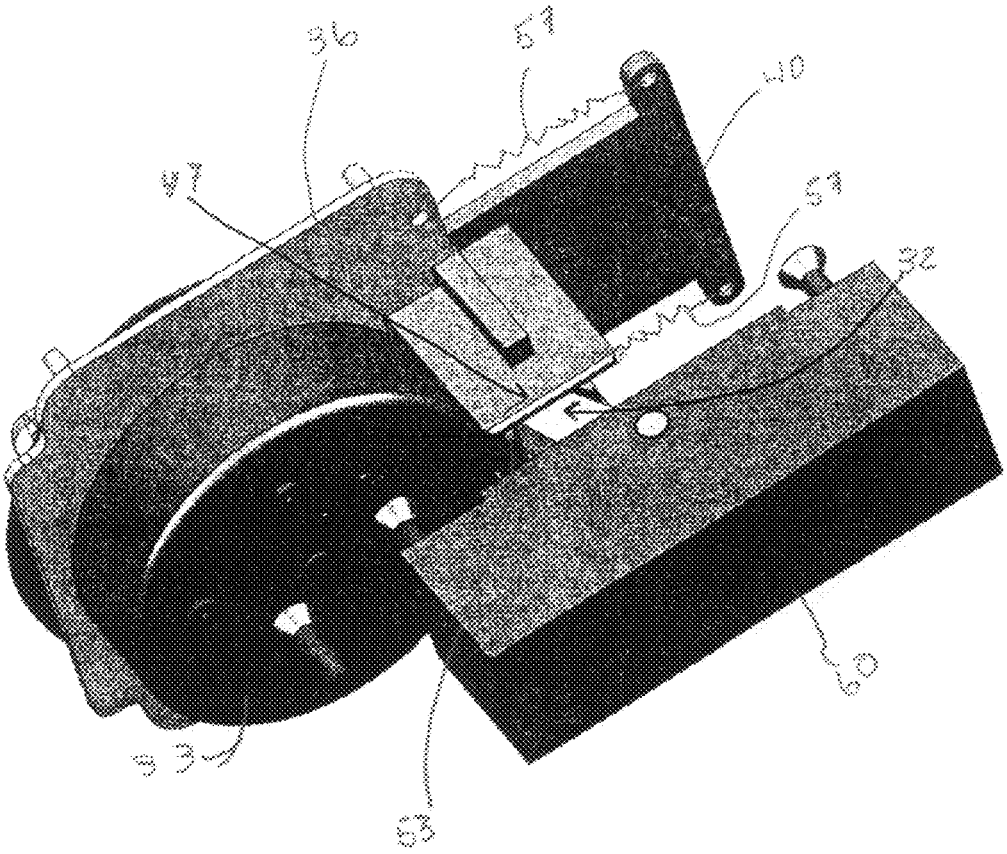
FIG. 6 is a perspective view showing the positional relationship between the actuator and the positioning plate while engaging a toggle switch.

FIGS. 3 and 5 best illustrate the delay timer of this invention when used to control operation of a rocker-type wall switch. As shown in FIG. 3, (and in FIG. 6 as well) at least one, and preferably two, springs 57 extend between the locating plate 36 and the actuator 40. Springs 57 are arranged to maintain the cam follower in sliding contact with the cam 38 and are tensioned sufficiently to cause the actuator to overcome the resistance experienced in changing the position of either a toggle or a rocker switch. Rails 46 and 47 extend through rail slots 48 and 49 in timer base plate 30 to rest upon and engage the arms of rocker member 55. Rail slots 48 and 49 are located above the rocker member e55e of the switch on opposite sides of opening 31 and generally parallel to it. FIG. 5 illustrates the actuator and cam mechanism of the delay timer when seen with the timer base plate removed. As is shown in this Figure, rails 46 and 47 are positioned to interact with the rocker member 55 of a conventional rocker type wall switch to turn it off and on as the rails move along the rocker surface in response to the rotational position of the cam.

Figure 4:
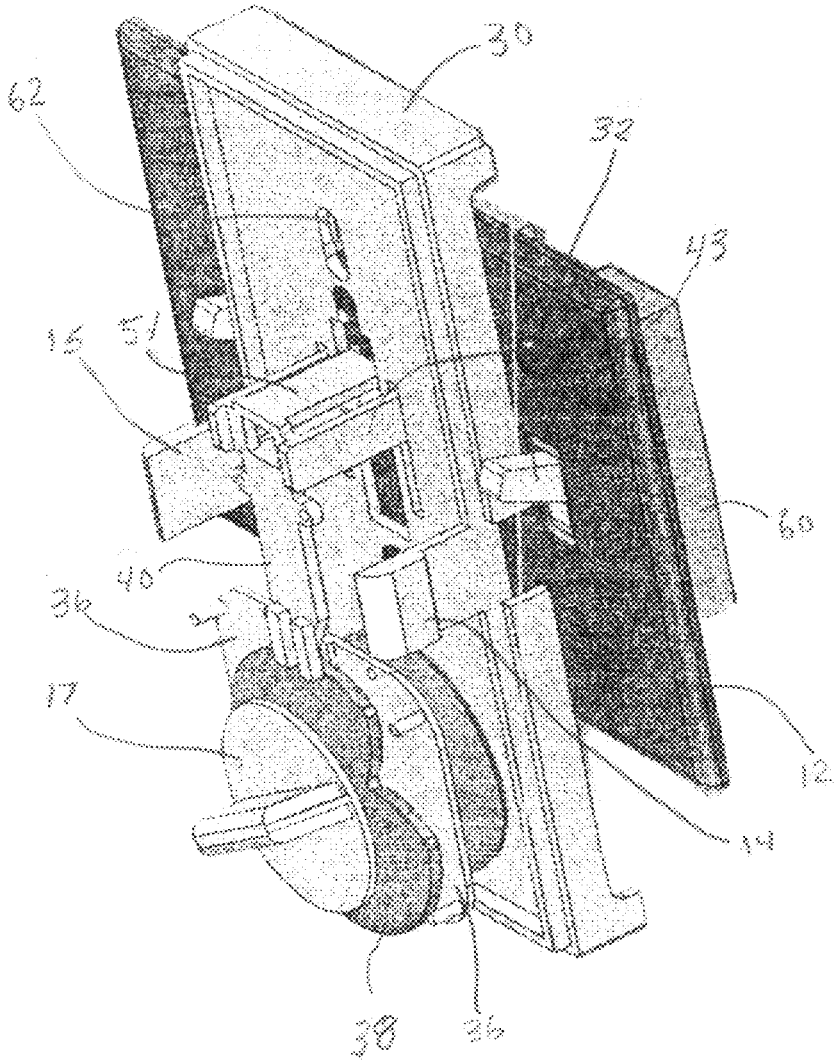
FIG. 4 is a perspective view showing the timer mechanism as mounted to one of a bank of toggle switches.

As was mentioned earlier, timer housing 11 is secured to the timer base plate 30 by means of tab locks 14 and 15 extending outwardly from the timer base plate 12 as is best shown in FIGS. 3 and 4. The timer base plate is attached over top of the switch cover plate 12 by means of screws that extend through the timer base plate and the switch cover plate into a tapped hole in the switch body 60. Because the standard cover plate hole spacing for toggle and for rocker switches differs, the mounting holes provided in the base plate are located to accommodate both standard hole spacings. It is preferred that the timer base and housing be sized so that the unit may be installed over any one of multiple adjacent switches without interference with the operation of adjacent switches as is shown in FIG. 4. The entire timer assembly can easily and safely installed without interruption of the electrical power to the switch as no wiring or electrical connections would be exposed during installation.

Many variations, modifications and additions may be made to the basic delay timer that is described herein. Such changes may include, for example, the incorporation of an accessory device within the empty available space or void area in the top part of the device above the actuator. That cavity may accommodate, for example, a transmitter arranged to produce a predetermined sequence of sounds such as music or a voice recording to be used in a nursery or child's room, or it may be a mechanically operated or battery powered music box or the like. Other accessory devices may be a digital or analog clock, a humidity or temperature monitor, a motion or sound sensor, a smoke detector and fire alarm and many others. The timer housing may be fabricated of a transparent plastic material so as to make the internal components and their operation visible, or may be supplied in various colors and decorative features. It is expected that the delay timer of this invention will find particular use in the control of hot tubs, pumps, fans, and other similar appliances and uses.

It is to be understood that many other changes and modifications may be made to the described delay timer without departing from the spirit and scope of the disclosed and claimed invention.

The invention claimed is:

1. A mechanical delay timer that operates either a toggle or a rocker-type wall switch, comprising:

a timer base plate that is sized to fit over and to be secured on top of an existing cover plate of a conventional toggle or rocker wall switch, said toggle switch having a lever to turn it on and off, said base plate having a generally rectangular opening therein, said opening positioned and sized to accommodate said toggle switch lever and to allow free movement of said lever;

a spring powered timer and a cam having a varying profile, said timer arranged to rotate the cam at a predetermined rate;

a switch actuator, said actuator including a cam follower member arranged to move the actuator in response to a change in the cam profile; and a pair of leg members fixed to and extending from the actuator, each leg member terminating in a rail that fits through a slot in said timer base plate, each said slot disposed at a side of and parallel to said rectangular opening, said rails positioned to interact with the rocker member of a rocker wall switch to turn the switch on or off as the actuator moves in response to a change in cam profile.

2. The timer of claim 1 including a housing arranged to fit over and secure to said timer base plate.

3. The timer of claim 2 including a locating plate arranged to hold the timer, cam and control knob in alignment.

4. The timer of claim 3 including at least one spring extending between said locating plate and the switch actuator and arranged to urge the cam follower to maintain sliding contact with the cam.

5. The timer of claim 1 including a back member extending between said leg members and arranged to interact with said toggle switch lever to turn the switch off as the actuator moves in response to a change in cam profile.

6. The timer of claim 1 including a front member extending between said leg members and arranged to interact with said toggle switch lever to turn the switch on as the actuator moves in response to a change in cam profile.

7. The timer of claim 1 wherein the timer base plate is provided with mounting holes that align with the mounting holes of the cover plate of a toggle wall switch.

8. The timer of claim 1 wherein the timer base plate is provided with mounting holes that align with the mounting holes of the cover plate of a rocker-type wall switch.

9. A mechanical delay timer for turning either a toggle switch or a rocker switch off at a predetermined time after the switch was turned on comprising:

a timer base plate adapted to fit over and to be secured on top of an existing cover plate of a conventional toggle or rocker wall switch, said toggle switch having a lever to turn it on and off, said base plate having a generally rectangular opening that is positioned and sized to accommodate said lever and to allow free movement of that lever, said base plate having a pair of slots extending through said plate, each said slot disposed at a side of and parallel to the rectangular opening at a location above the rocker member of a rocker wall switch;

a mechanical timer disposed upon the base plate and arranged to drive a cam at a predetermined rate;

an actuator arranged to engage either the toggle lever of a toggle wall switch or the rocker member of a rocker wall switch and to move the switch to its off position; and a cam follower arranged to move the actuator at a time directed by the cam, said movement of the actuator causing the switch to move to its off position.

10. The timer of claim 9 wherein a pair of leg members are fixed to and extend from said actuator, each leg member terminating in a rail that is sized and positioned to fit through a corresponding one of said slots.

11. The timer of claim 10 wherein the rails are positioned to interact with the rocker member of a rocker wall switch and to turn the switch on or off as the actuator moves as directed by the cam.

12. The timer of claim 9 wherein the base plate includes two sets of mounting holes, one said set aligned with the mounting holes provided in the cover plate of a toggle wall switch, and the other said set aligned with the mounting holes provided in the cover plate of a rocker wall switch.

13. The timer of claim 9 including an accessory device that is installed above said actuator.

14. The timer of claim 13 wherein the accessory device is a transmitter that is arranged to produce a predetermined sequence of sounds.

* * * * *